US008720328B2

(12) United States Patent
Kuboe

(10) Patent No.: US 8,720,328 B2
(45) Date of Patent: May 13, 2014

(54) CONTROL DEVICE OF SERVO PRESS AND METHOD FOR CONTROLLING SERVO PRESS

(75) Inventor: Kazuhiro Kuboe, Kanagawa (JP)

(73) Assignee: AIDA Engineering, Ltd., Kanagawa (JP)

( * ) Notice: Subject to any disclaimer, the term of this patent is extended or adjusted under 35 U.S.C. 154(b) by 142 days.

(21) Appl. No.: 13/289,095

(22) Filed: Nov. 4, 2011

(65) Prior Publication Data

US 2012/0111207 A1 May 10, 2012

(30) Foreign Application Priority Data

Nov. 9, 2010 (JP) ..... 2010-250953

(51) Int. Cl.
*B30B 13/00* (2006.01)

(52) U.S. Cl.
USPC ..... 100/35; 100/50; 318/434; 318/566; 72/20.2

(58) Field of Classification Search
USPC ..... 100/35, 43, 48, 50; 72/20.1, 20.2, 21.1, 72/31.11; 700/206; 318/560, 566, 569, 318/600, 430–434
See application file for complete search history.

(56) References Cited

U.S. PATENT DOCUMENTS 2,893,530 A * 7/1959 Curtner ..... 192/56.4
6,211,636 B1 * 4/2001 Matsubara et al. ..... 318/434
6,337,042 B1 * 1/2002 Nakashima et al. ..... 264/40.5
7,434,505 B2 * 10/2008 Suzuki et al. ..... 100/43
7,868,576 B2 * 1/2011 Kosaka ..... 318/566
8,047,131 B2 * 11/2011 Onishi et al. ..... 100/35
2011/0061547 A1 * 3/2011 Nagase et al. ..... 100/35
2011/0132208 A1 * 6/2011 Asakawa et al. ..... 100/35
2011/0132209 A1 * 6/2011 Senda et al. ..... 100/35

FOREIGN PATENT DOCUMENTS

JP 2004-174591 A 6/2004

OTHER PUBLICATIONS

Machine Translation of JP 2004-174591, (Listed in IDS Nov. 4, 2011).*

* cited by examiner

*Primary Examiner* — Shelley Self
*Assistant Examiner* — Leonel Vasquez
(74) *Attorney, Agent, or Firm* — McDermott Will & Emery LLP

(57) ABSTRACT

A control system of a servo press and a control method are provided for preventing an overload on a pressure capability of a press and a torque capability of a drive system. A control device of a servo press for pressing by transferring a drive force of a servomotor to a slide via a drive mechanism includes: a motion calculation unit for calculating slide target position data; a torque calculation unit for calculating process torque for pressing and control torque for speed change of the servo motor on the basis of slide target position data; a process system limit unit for limiting the calculated process torque to predetermined process limitation torque; and a drive system limit unit for limiting combined torque of the limited process torque and the control torque to predetermined drive limitation torque. The servo motor is driven on the basis of a command of drive limitation torque.

9 Claims, 9 Drawing Sheets

CONTROL DEVICE OF SERVO PRESS AND METHOD FOR CONTROLLING SERVO PRESS

CROSS REFERENCE TO RELATED APPLICATIONS

The present application claims priority under 35 U.S.C. §119 to Japanese Patent Application No. 2010-250953, filed Nov. 9, 2010, which is incorporated herein by reference.

BACKGROUND OF THE INVENTION

1. Field of the Invention

The present invention relates to a control device of a servo press and a method for controlling a servo press for driving a slide by a servomotor via, e.g., an eccentric mechanism using a crank shaft and an eccentric shaft and a doubling mechanism using a knuckle mechanism and a linkage mechanism.

2. Related Art of the Invention

FIG. 1 shows a structure of a popular machine press. The energy of a flywheel 3 is transferred from a pinion gear 5 to a main gear 6 via a clutch 4 including fraction plates to drive a crankshaft 8 and to thereby raise or lower a slide 10.

The clutch 4 has a torque transfer capability satisfying the stroke pressure diagram of FIG. 3 showing a pressure force of the press. High torque of the flywheel 3 is transferred to the clutch 4, by which the transfer torque is limited to at or below required torque. Therefore, the clutch 4 does not stress the drive system including the pinion gear 5, the main gear 6, the crankshaft 8, and a connecting rod 9.

FIG. 2 is a structure diagram of a popular servo press, in which the clutch 4 used in the above machine press is not provided and a servomotor 11 is connected to the pinion gear 5 directly or via a deceleration gear. To control the servo press by numeric values such as a position and speed of the slide 10, the rotary position of the servomotor 11 and the position of the slide 10 remain stationary relative to one another, without providing the clutch 4 of the machine press.

As the servomotor 11, a motor having enough high torque to satisfy the stroke pressure diagram of FIG. 3 is selected. Therefore, a pressure force that can be generated by the servo press is shown in the diagram of the servo press of FIG. 3. In FIG. 3, the horizontal axis shows a height (the unit is mm) from the bottom dead center of the slide and the vertical axis shows a pressure force (the unit is kN) of the press.

However, the servomotor 11 can generate sufficient torque, but when excessive torque is applied in the structural design of the press machine, the drive system including the pinion gear 5 and main gear 6 is damaged, e.g., to pitch. Then, when continuously used, the press machine may be broken.

Past overload protection devices for presses include: a protection device having an oil pressure chamber provided to the connection portion of the connecting rod 9 and slide 10 to leak oil pressure when a pressure force at or over a preset pressure force is generated; and an overload detection device having a strain gauge attached to a frame of a press machine to detect a pressure force as extension of the frame and to stop the press when detecting a predetermined value or over.

However, a speed of the servomotor 11 is variable also during pressing. The torque transferred from the servomotor 11 to a drive shaft changes between the acceleration and deceleration of the servomotor 11 even when the pressing load does not change. The overload protection devices of past machine presses cannot protect the presses.

As a measure for this disadvantage in JP-A No. 2004-174591, to protect a machine of a servo press, motor torque is decreased in response to an eccentric shaft rotation angle to keep a limitation value of a slide pressure force generally constant near the slide bottom dead center.

SUMMARY OF THE INVENTION

However, in actual pressing, the case in which pressing is performed only near the bottom dead center is limited to blanking. In drawing etc. unlike the blanking, pressing is performed from a high position of a slide before the bottom dead center. Therefore, in the technique disclosed in the JP-A No. 2004-174591, a pressure force may not be limited during pressing such as drawing, and thus high torque may damage the drive system and the machine.

The motor torque generates inertial energy by the high rotation in the motor and drive system connected to the motor separately from the process torque against the disturbance torque in pressing, and the inertial energy becomes inertial torque for assisting the motor in proportion to the motor speed. On the other hand, a friction force due to the rotation generated in the drive system becomes friction torque for loading the motor. The inertial torque and friction torque are mechanical torque fluctuation elements generated by rotating the motor, and collectively named fluctuating torque.

Fluctuating torque=inertial torque+friction torque

In the servo press, the motion in pressing is characteristically arbitrarily changed. Required torque is different in pressing during acceleration of the motor and in pressing during deceleration of the motor. When acceleration-deceleration torque determined by motion and fluctuating torque which fluctuates according to a motor speed are collected as control torque, required motor torque is expressed by the following formula.

Motor torque=process torque (disturbance opposing torque)+control torque (acceleration-deceleration torque+fluctuating torque)

In the method of reduction of motor torque in response to an eccentric rotation angle disclosed in JP-A No. 2004-174591, fa control torque element fluctuating when pressing during deceleration of the motor is not taken into consideration. Therefore, this method is not sufficient for the press machine protection.

FIG. 4 shows a control device of a popular servo press. A press information storage unit 20 previously stores, as parameters, information such as a press capability, a slide stroke length, a deceleration ratio defined by the number of teeth of the pinion gear 5 and the number of teeth of the main gear 6, a length of the connecting rod 9 (see FIG. 2 for these components), and a moment of inertia of a drive system.

In a motion data setting unit 21, a motion of one cycle operation of a press slide 28 is partitioned on the basis of a slide position, and set and inputted as strokes. As shown in motion data 22, data set in the motion data setting unit 21 are set and inputted as a slide position and a slide speed for each stroke.

In the example of FIG. 4, the first stroke begins from a slide position of 800 mm (height from the slide bottom dead center), the second stroke begins from a slide position of 200 mm, the third stroke begins from a slide position of 0 mm (bottom dead center), and the final fourth stroke begins from a slide position of 800 mm. A slide speed is expressed by a ratio, which becomes 100% when the slide speed is the fastest on the specification of the press on the basis of the motor speed. An interval speed from the first stroke until second stroke is 100%, which is set in the speed column of the first stroke, an interval speed from the second stroke until third stroke is 50%, which is set in the speed column of the second stroke, and an interval speed from the third stroke until fourth stroke is 100%, which is set in the speed column of the third stroke.

In the motion calculation unit 23, each time a control for the motor may be required, a calculation is made to determine a slide target position where the slide is to move. An input signal of a starter 24 is triggered to output slide target position data of the calculation result to an amplifier 25. Since a servomotor 26 and a crank 27 are engaged in a predetermined relationship, the servomotor 26 rotates by a control of the amplifier 25 to raise and lower the press slide 28.

When the servomotor 26 and crank 27 are engaged in the servo press of FIG. 4, required motor torque generates a pressure force on the stroke pressure diagram in response to a slide position, and actual motor torque is the maximum torque of only the servomotor 26. Then, to provide allowance to the actual motor torque, the relationship between the required torque and actual motor torque is shown by the following Formula and FIG. 5.

Required torque<Actual motor torque

FIG. 6 shows the stroke pressure diagram (actual) in contrast to the stroke pressure diagram (specification) defined as a mechanical specification when the actual motor torque is not limited. In FIG. 5 and FIG. 6, the horizontal axis shows a height (mm) from the bottom dead center of the slide, the left vertical axis shows a pressure force (kN) of the press, and the right vertical axis shows torque (unit kNm).

It is clear from two stroke pressure diagrams of FIG. 6 that, unless the torque of the servomotor is limited along the stroke pressure diagram (specification) over all the slide strokes, the drive system and the machine may be damaged.

For addressing the above disadvantages, the present invention provides a control device of a servo press and control method to prevent an overload on a pressure capability of a press and a torque capability of a drive system.

A control system of a servo press for pressing by transferring a drive force of a servo motor to a slide via a drive mechanism includes: an encoder for outputting current position data; a press information storage unit for storing information unique to a press device; a motion data setting unit for setting therein a slide position and a slide speed; a motion calculation unit for calculating slide target position data on the basis of information from the encoder, the press information storage unit, and the motion data setting unit; a torque calculation unit for calculating process torque for pressing and control torque for speed change of the servo motor on the basis of the slide target position data; a process system limit unit for limiting the calculated process torque to predetermined torque; and a drive system limit unit for limiting combined torque of the limited process torque and the control torque to predetermined drive torque. The servomotor is driven on the basis of the limited drive torque.

In the control device of the servo press, the process system limit unit limits the process torque to process limitation torque at or below a pressure capability of a press unique to a press device.

In the control device of the servo press, the drive system limit unit limits the combined torque to at or below a torque capability of a drive system unique to a press device.

In the control device of the servo press, the torque calculation unit includes: a process torque generation unit for outputting process torque on the basis of slide target position data and current position data from the encoder; and a control torque generation unit for outputting control torque on the basis of slide target position data and information unique to a press device.

In the control device of the servo press, information unique to a press device in the press information storage unit is arbitrarily set.

For addressing the above disadvantages, the present invention provides a method for controlling a servo press by transferring a drive force of a servo motor driven via a drive mechanism on the basis of slide target position data. The servo press includes: an encoder for outputting current position data; a press information storage unit for storing information unique to a press device; a motion data setting unit for setting therein a slide position and a slide speed; and a motion calculation unit for calculating slide target position data on the basis of information from the encoder, the press information storage unit, and the motion data setting unit. The method includes: calculating process torque for pressing and control torque for speed change of a servomotor on the basis of slide target position data; limiting the calculated process torque to predetermined torque; and limiting combined torque of the limited process torque and control torque to predetermined drive torque; then, the servomotor is driven on the basis of the limited drive torque.

In the method for controlling the servo press, the calculated process torque is limited to process torque at or below a press pressure capability unique to the press device.

In the method for controlling the servo press, combined torque of the limited process torque and the calculated control torque is limited to at or below a drive torque capability of a drive system unique to the press device.

In the method for controlling the servo press, the process torque is outputted on the basis of slide target position data and current position data from the encoder, and the control torque is outputted on the basis of slide target position data and unique information to the press device.

Advantageous Effect of the Invention

According to the present invention, the overload on a pressure capability of a press and a torque capability of a drive system can be prevented certainly to prevent damage to the drive system and the machine.

DETAILED DESCRIPTION OF THE EMBODIMENTS

Figure 1:
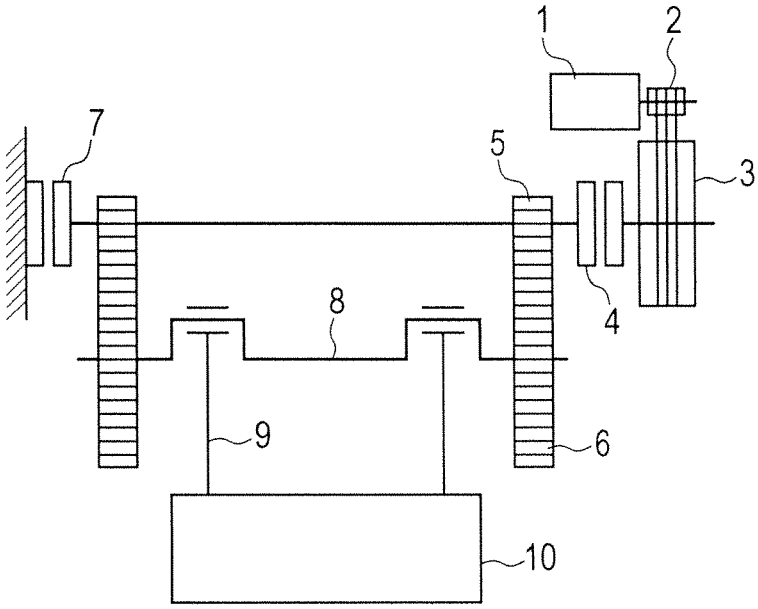
FIG. 1 Prior Art
FIG. 1 is a structural diagram of a popular machine press.
Figure 2:
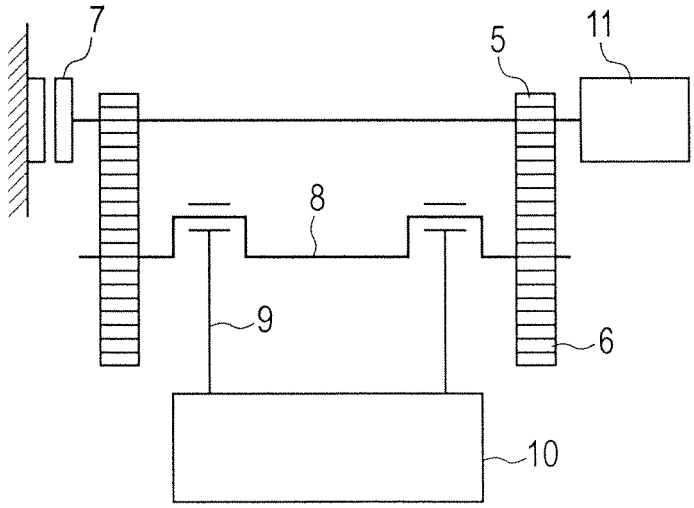
FIG. 2 Prior Art
FIG. 2 is a structural diagram of a popular servo press.
Figure 3:
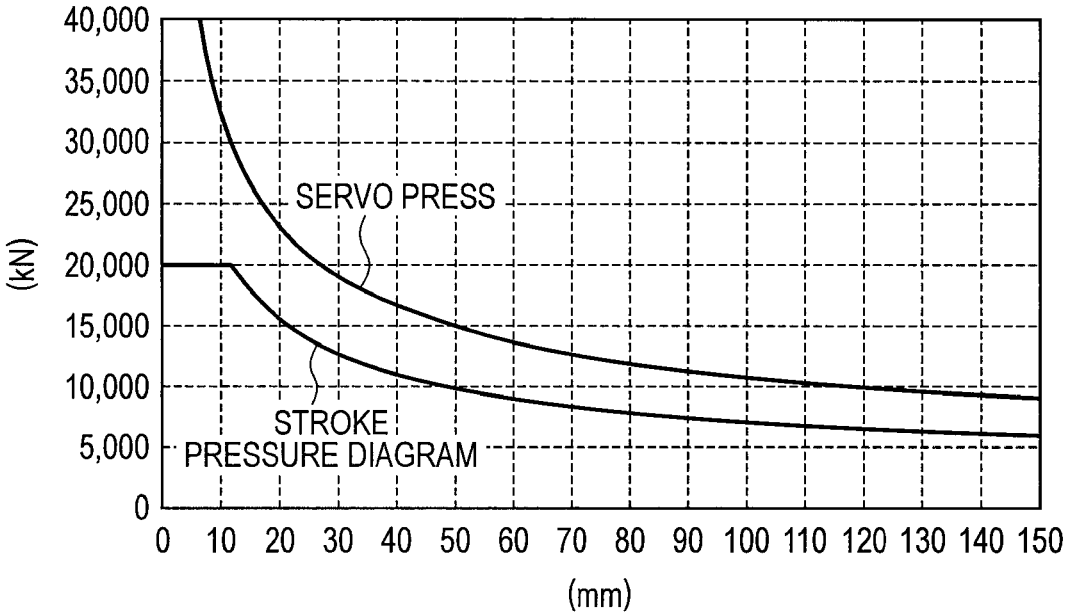
FIG. 3 is a characteristic diagram showing relationship between a stroke pressure diagram and a diagram of a servo press.
Figure 4:
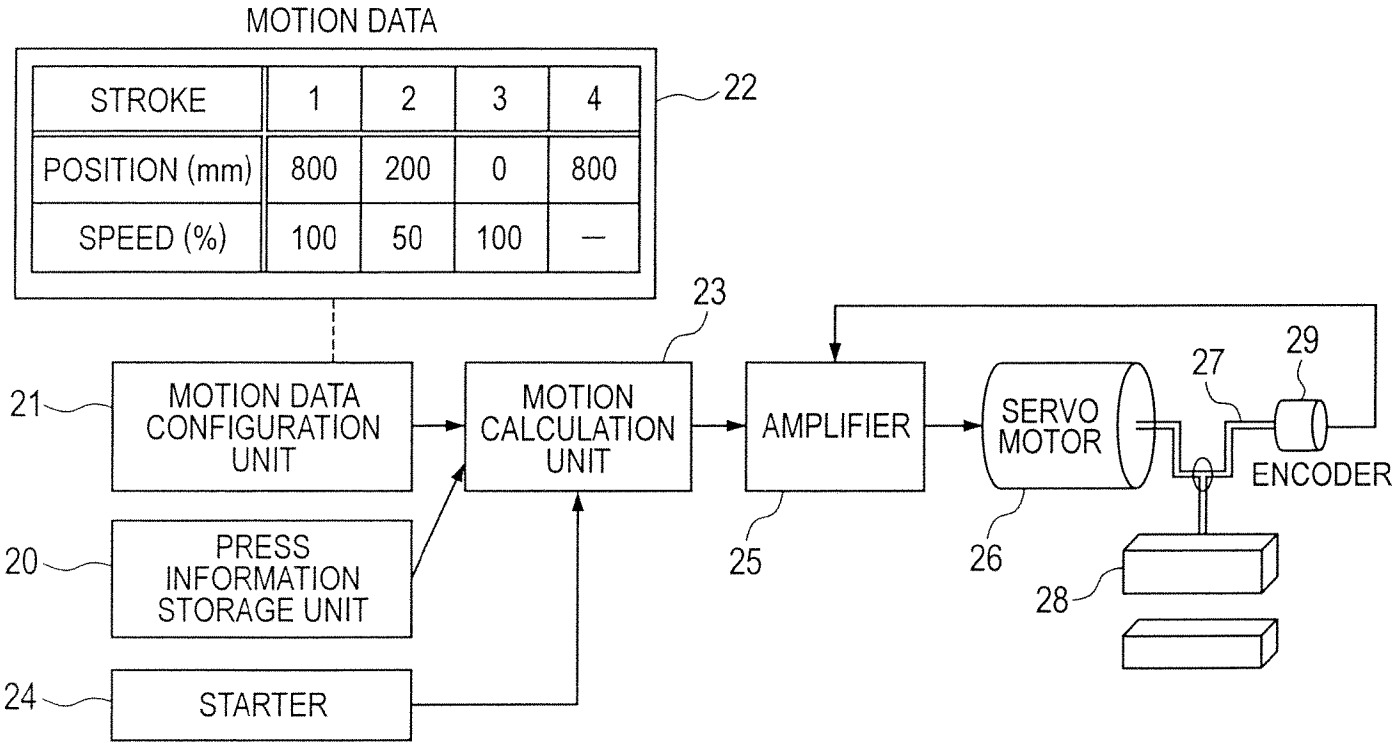
FIG. 4 Prior Art
FIG. 4 is a block diagram of a control device of a popular servo press.
Figure 5:
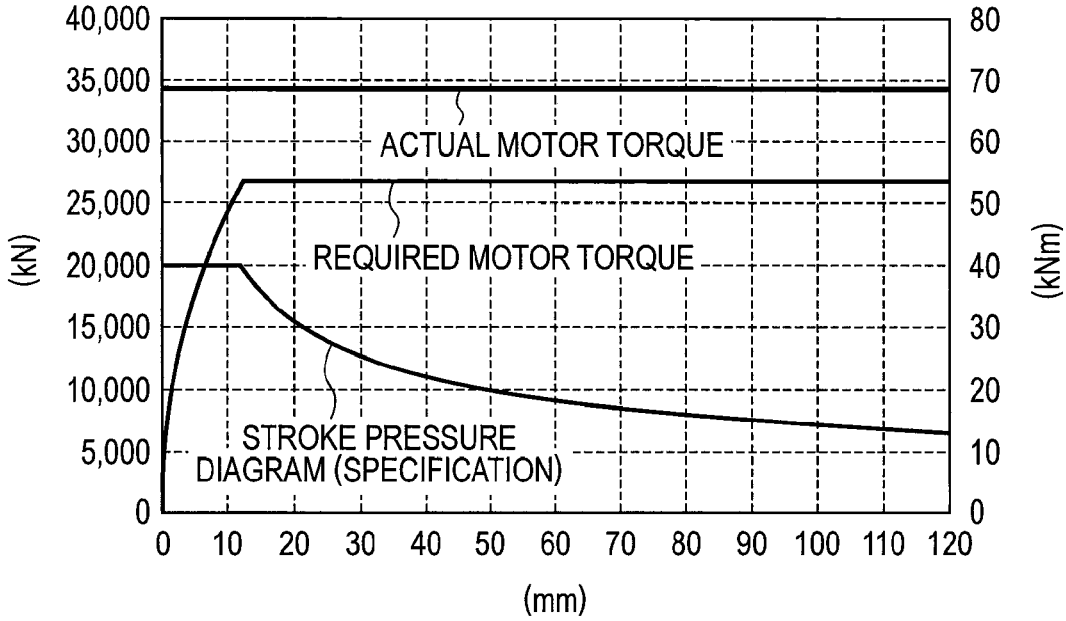
FIG. 5 is a characteristic diagram showing relationship between actual motor torque and required motor torque.
Figure 6:
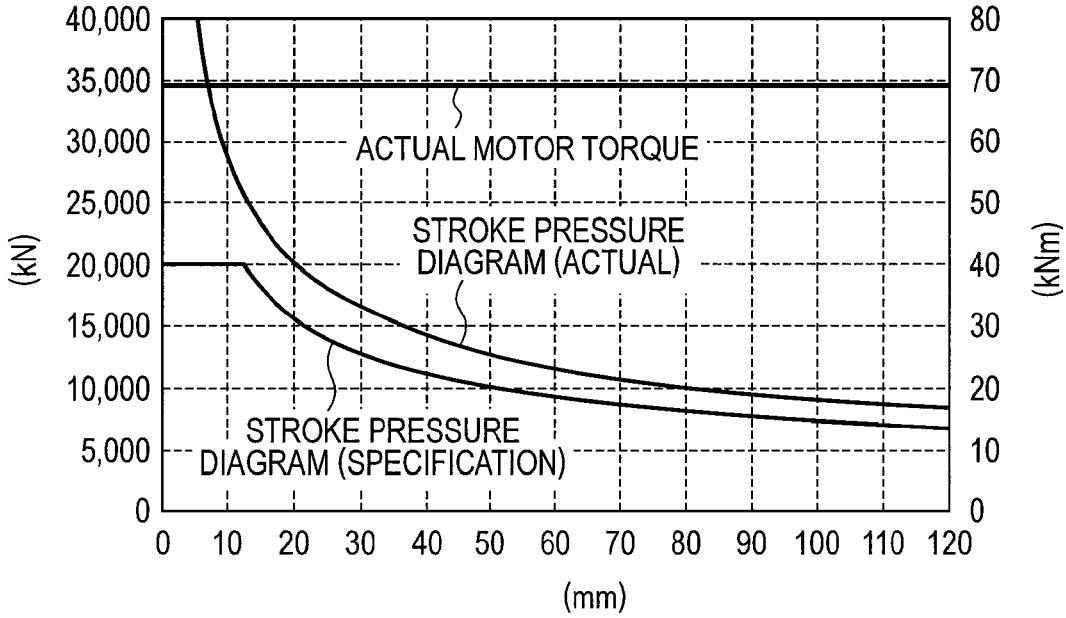
FIG. 6 is a characteristic diagram when actual motor torque is not limited.
Figure 7:
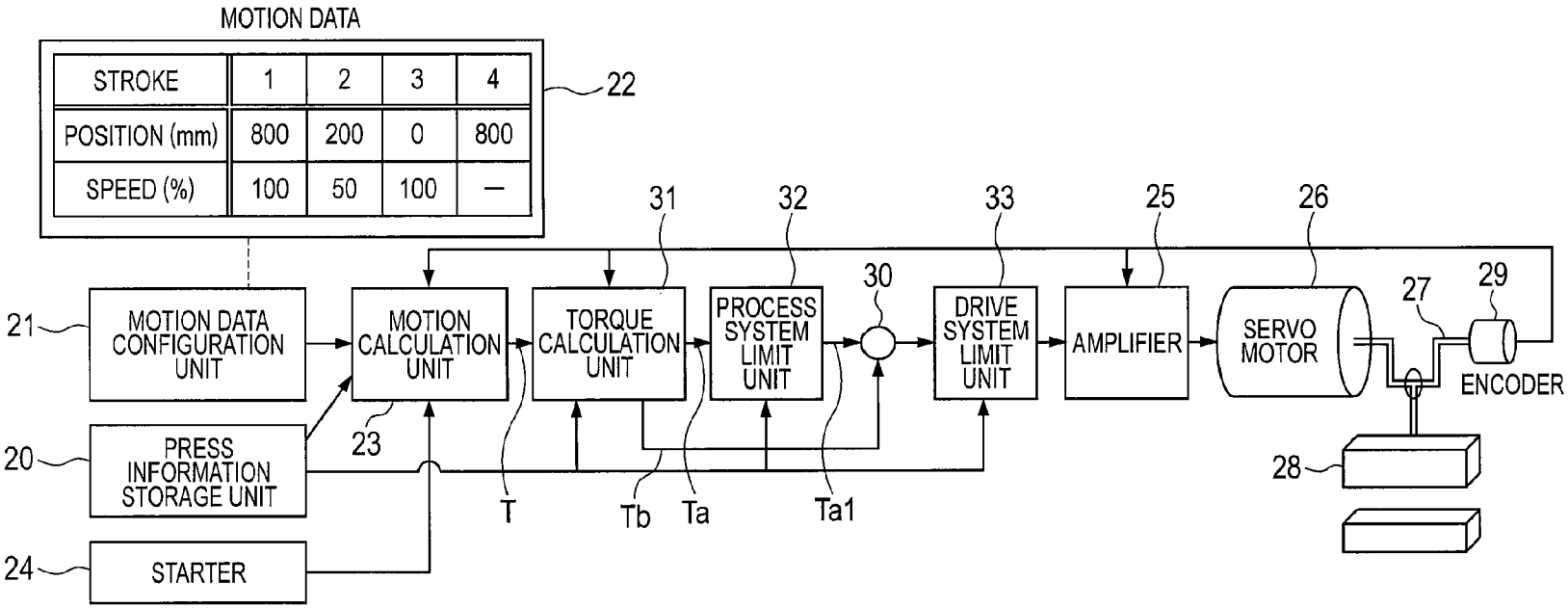
FIG. 7 is a block diagram of a control system of an embodiment of the present invention.

FIG. 7 explains an embodiment of the present invention. The hardware structure in this embodiment uses the structure of the servo press of FIG. 2. In FIG. 7, components similar to those in FIG. 4 are given similar reference signs.

A press information storage unit 20 stores, in advance as parameters, information unique to a press device, such as a press capability (pressure force etc.), a slide stroke length, a reduction ratio defined by the number of teeth of a pinion gear 5 and the number of teeth of a main gear 6, a length of connecting rod 9, and a moment of inertia of a drive system. Information Unique to a press device is arbitrarily set because a press capability (pressure force etc.) changes when a press mold is replaced.

In a motion data setting unit 21, a motion of a one cycle operation of a press slide 28 is partitioned on the basis of a slide position (a height from the bottom dead center of the slide 28) and set as strokes. As shown in motion data 22, a slide position and a slide speed are stored for each stroke in advance as data set in the motion data setting unit 21.

In the example of FIG. 7, the first stroke begins from a slide position of 800 mm (slide top dead center), the second stroke begins from a slide position of 200 mm, the third stroke begins from a slide position of 0 mm (slide bottom dead center), and the last fourth stroke begins from a slide position of 800 mm. A slide speed is expressed by a ratio, which becomes 100% when the slide speed is the fastest on the specification of the press on the basis of the motor speed. An interval speed from the first stroke until second stroke is set and stored in a speed column of the first stroke as 100%, an interval speed from the second stroke until third stroke is set and stored in a speed column of the second stroke as 50%, and an interval speed from the third stroke until fourth stroke is set and stored in a speed column of the third stroke as 100%.

Into a motion calculation unit 23, information unique to the press device from the press information storage unit 20, motion data of one cycle operation of the press slide 28 set in the motion data setting unit 21, and current position data of the slide 28 fed back from an encoder 29 are inputted. The encoder 29 detects a position of the slide 28 via a crank 27. A rotational position of a servomotor 26 may be detected.

On the basis of the above-mentioned three sorts of data, the motion calculation unit 23 calculates a target position where the slide is to move in each time the motor is required to be actually controlled, and outputs slide target position data T of the calculation result to a torque calculation unit 31 when an input signal of a starter 24 is triggered.

Figure 8:
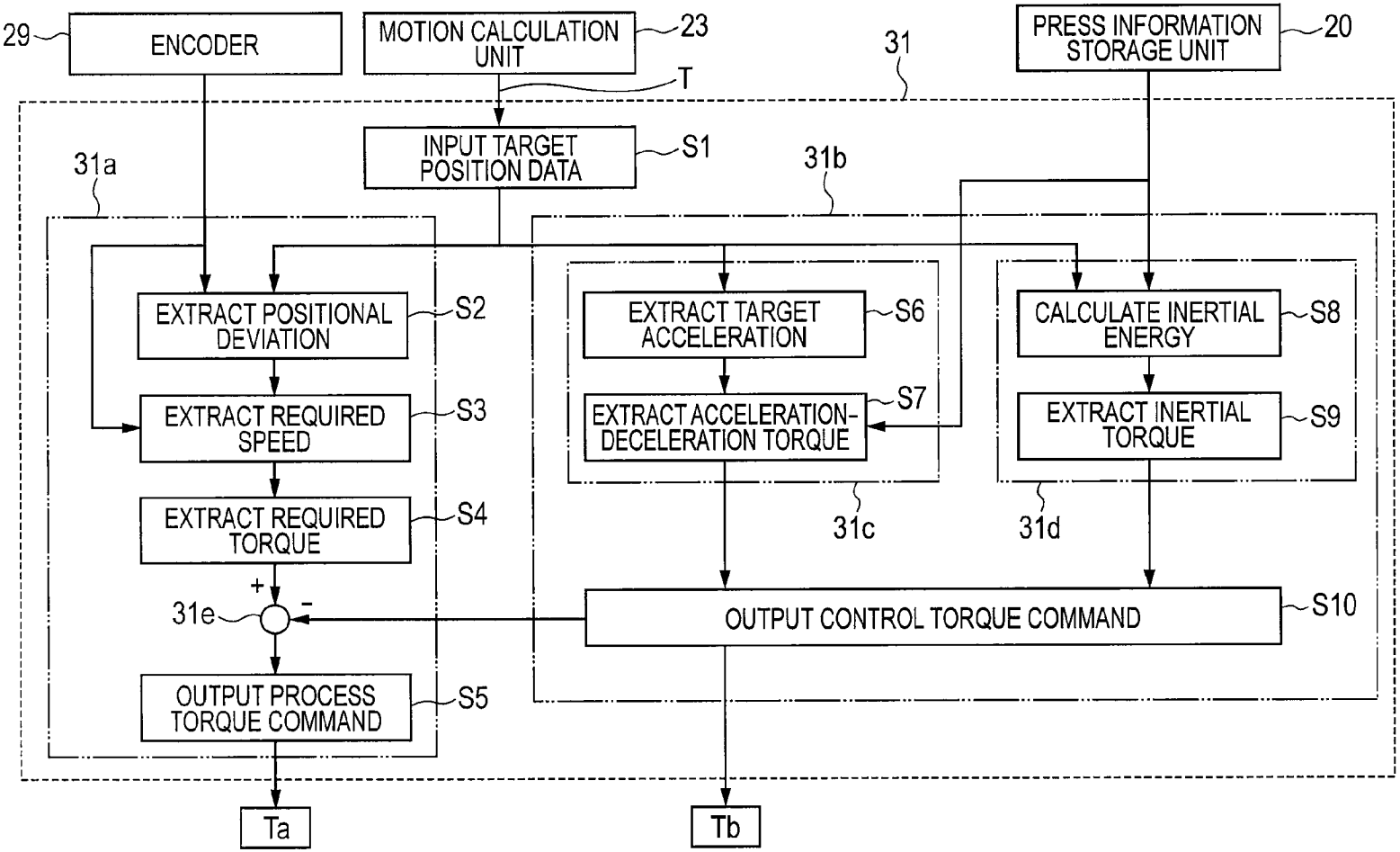
FIG. 8 is a block diagram of a torque calculation unit of an embodiment of the present invention.

In addition to the slide target position data T from the motion calculation unit 23, information unique to the press device from the press information storage unit 20 and current position data fed back from the encoder 29 are inputted into the torque calculation unit 31. In the torque calculation unit 31, process torque Ta and control torque Tb are calculated on the basis of the above-mentioned three sorts of data and on the basis of the inputted slide target position data T. Hereafter, the structure and operations of the torque calculation unit 31 are explained in reference to FIG. 8.

The torque calculation unit 31 includes a process torque generation unit 31*a* and a control torque generation unit 31*b*. The control torque generation unit 31*b* includes an acceleration-deceleration torque extraction unit 31*c* and an inertial torque extraction unit 31*d*. Operations in the torque calculation unit 31 are exceeded according to the procedure shown by operation steps (S).

The slide target position data T outputted from the motion calculation unit 23 is stored temporarily in Step 1 (S1). The slide target position data T is inputted into the process torque generation unit 31*a*, the acceleration-deceleration torque extraction unit 31*c*, and the inertial torque extraction unit 31*d*. The current position data fed back from the encoder 29 is inputted into the process torque generation unit 31*a*. Information Unique to the press device from the press information storage unit 20 is inputted into the acceleration-deceleration torque extraction unit 31*c* and inertial torque extraction unit 31*d*.

In the process torque generation unit 31*a*, the current position data and the slide target position data T are compared in Step S2 to extract an amount of positional deviation. An amount of increase and decrease of a speed required to recover the position difference is extracted as a required speed (Step S3), and an amount of increase and decrease of the required torque according to the amount of increase and decrease of this speed is extracted as required torque (Step S4). The required torque extracted in Step S4 is combined torque that contains process torque for pressing and control torque including acceleration-deceleration torque and inertial torque of a motor.

In the acceleration-deceleration torque extraction unit 31*c*, a target acceleration is extracted in Step S6 on the basis of the slide target position data T, and acceleration-deceleration torque is extracted in Step S7 on the basis of target acceleration and information unique to a press device. An amount of positional deviation of the slide target position data T per a unit time is a target speed. An amount of speed deviation of this speed data per a unit time is a target acceleration. On the basis of a moment of inertia value of the drive system in information unique to the press device stored in the press information storage unit 20 and the target acceleration extracted in Step S6, acceleration-deceleration torque required in changing a motion of the press slide can obtained in Step S7.

In the inertial torque extraction unit 31*d*, inertial energy is calculated in Step S8 on the basis of the slide target position data T and the information unique to the press device, and inertial torque is extracted from the inertial energy in Step S9. On the basis of a target speed, which is a positional deviation of the slide target position data T per a unit time, and a moment of inertia of the drive system stored in the press information storage unit 20 in advance, inertial energy is calculated in Step S8. The deviation per a unit time of this inertial energy is power, and on the basis of this power and the above-mentioned target speed, inertial torque for assisting motor torque is obtained in Step S9.

In the control torque generation unit 31*b*, the acceleration-deceleration torque extracted in Step S10 in the acceleration-deceleration torque extraction unit 31*c* and the inertial torque extracted in the inertial torque extraction unit 31*d* are combined in Step S10, and the control torque command (control torque) Tb is outputted.

In the process torque generation unit 31*a*, the control torque Tb is subtracted from the required torque that has been extracted in a deviation unit 31*e* in Step S4, and the process torque command (process torque) Ta is outputted in Step S5.

As shown in FIG. 7, the process torque Ta is transferred to a process system limit unit 32, a press pressure force is limited to motor torque at or below the stroke pressure diagram (specification), and outputted as process limitation torque Ta1. This limitation is made on the basis of a pressure capability (pressure force etc.) of the press stored in the press information storage unit 20. The process system limit unit 32 includes a limiter for limiting the process torque Ta to at or below a predetermined value (stroke pressure diagram).

The process limitation torque Ta1 is combined with the control torque Tb that has been previously outputted from the torque calculation unit 31 in a combination unit 30. The combined torque of the process limitation torque Ta1 and control torque Tb is transferred to a drive system limit unit 33, and is limited to drive torque which the drive system can tolerate (drive mechanism). On the basis of a drive torque capability of the drive system unique to the press device stored in the press information storage unit 20, the limitation is performed by the limiter not to exceed the drive torque capability.

The limited drive torque is outputted to an amplifier 25. Since the servomotor 26 and crank 27 are engaged in a predetermined relationship, the press slide 28 rises and lowers by rotation of the servomotor 26.

For example, when the slide (motor) is further accelerated during molding requiring the press pressure force (process torque) along the stroke pressure diagram (specification), the process torque is not problematical, but the drive torque generated by combining the process torque and control torque (acceleration torque) is applied to the drive system. As a result, the drive torque may exceed torque which the drive system can tolerate.

Similarly, when processing is carried out while the slide decelerates, the process torque and minus control torque are combined. Asa result, even when the press pressure force over the stroke pressure diagram is generated, this generation may not be observed in view of the motor torque.

In this embodiment, the above disadvantage is avoided by limiting each torque in the process system limit unit 32 and drive system limit unit 33 separately. The process torque of the process system is limited in the process system limit unit 32, and after that, the control torque of the drive system including the limited torque of the process system (process limitation torque Ta1) is limited. As a result, each torque of the process system and drive system can be limited to at or below each capability of the process system and drive system certainly.

Figure 9:
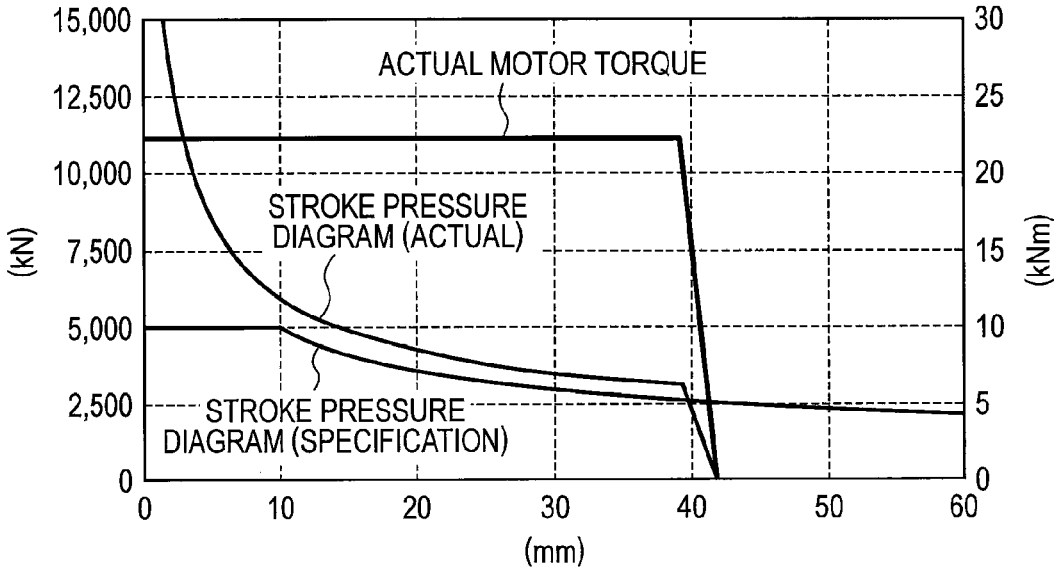
FIG. 9 is a characteristic diagram when higher motor torque than that of specification is outputted.

FIG. 9 shows the assumption in which, in a past popular servo press, motor torque (actual motor torque) over required motor torque of the stroke pressure diagram (specification) may need to be outputted for a press target (load) from a position of approximately 40 mm from the press bottom dead center. The stroke pressure diagram (actual) shows a press pressure force relative to a position from the press bottom dead center. The horizontal axis shows a height (mm) from the bottom dead center of the slide, the left vertical axis shows a pressure force (kN) of the press, and the right vertical axis shows torque (kNm).

On or after the height is equal to or under 40 mm at which pressing begins, the force exceeding the stroke pressure diagram (specification) is generated on the stroke pressure diagram (actual). Accordingly, the drive system and machine system have been already damaged at this time.

Figure 10:
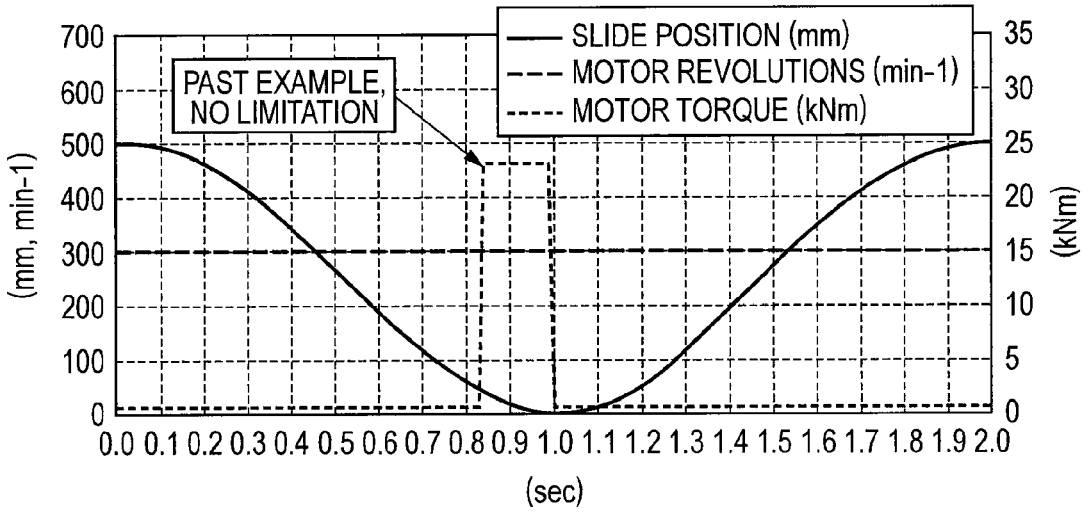
FIG. 10 is a characteristic diagram when a motor speed is constant without torque limitation.

FIG. 10 shows a slide position (left vertical axis), a motor speed (left vertical axis), and motor torque (right vertical axis) when pressing is carried out without torque limitation, on the time axis (horizontal axis). FIG. 10 shows the example in which the pressing corresponding to the stroke pressure diagram (actual) is carried out while the motor speed is constant at 300 min−1. The motor torque rises to 23 kNm steeply after 0.8 second at which a height from the press bottom dead center is 40 mm. The motor torque lowers steeply after the bottom dead center. Since the motor speed is constant, only the process torque has appeared as the motor torque.

Figure 11:
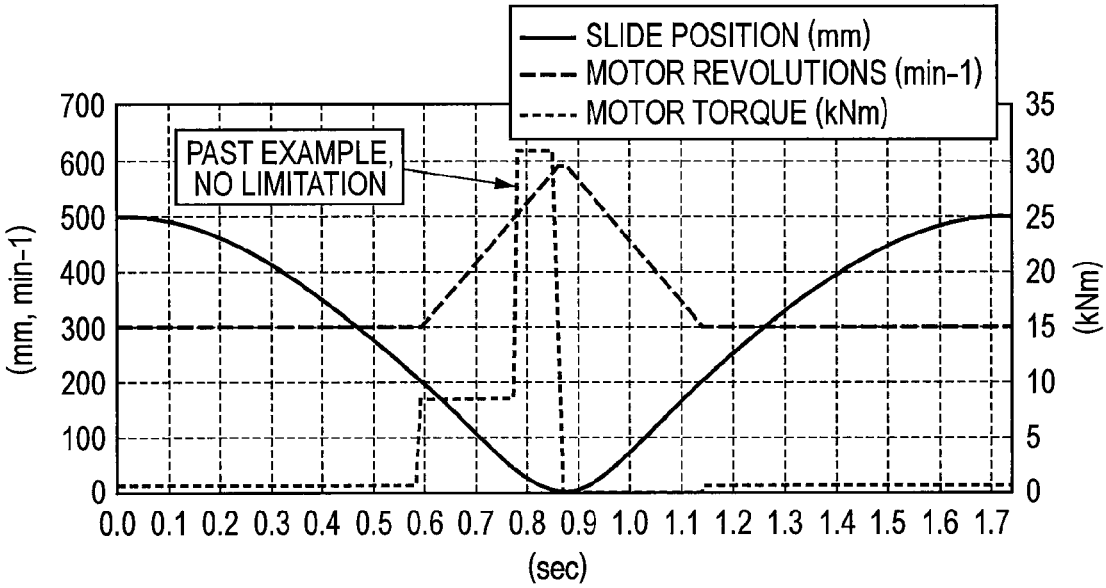
FIG. 11 is a characteristic explanation diagram when a motor speed is changed without torque limitation.

FIG. 11 shows the example in which the same pressing as FIG. 10 is carried out while the motor speed rises from 300 min−1 to 600 min toward the bottom dead center without limitation after 0.6 second at the position of 200 mm from the press bottom dead center. When the motor speed of FIG. 10 is constant, motor torque of 23 kNm may be required for the pressing. In FIG. 11, the torque for accelerating the motor is 8 kNm generated after 0.6 second. To this torque, 23 kNm required for the pressing is added. As a result, unless the motor torque of 31 Nm is outputted, the pressing is impossible. This is expressed by the following formula.

31 kNm (motor torque)=23 kNn (process torque)+8 kNm (control torque)

Even when the process torque value (23 kNm) is converted into the pressure capability and torque capability of the press to be at or below the limitation of the capabilities, control torque (8 kNm) is added to the process torque together. As a result, the motor torque (31 kNm) may exceed the limitation of the drive system. The control torque is produced by combining acceleration-deceleration torque determined by the motion and the inertial torque determined by the motor speed and the moment of inertia of the drive system.

The example in which machine protection is carried out according to this embodiment is explained below. The process torque Ta is the motor torque when the pressing corresponding to the stroke pressure diagram (actual) of FIG. 9. The generation of this torque without change causes damage to the drive system and machine.

Figure 12:
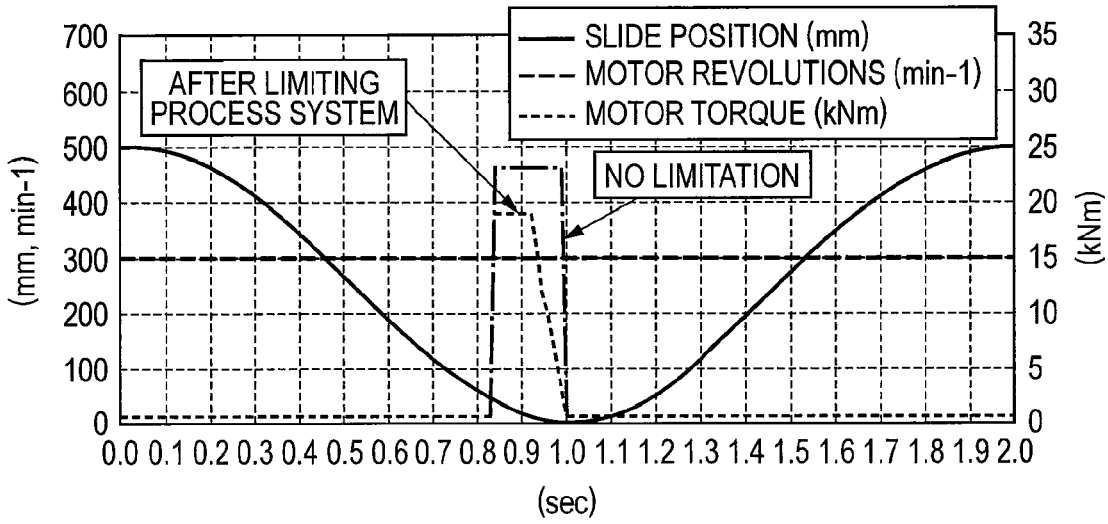
FIG. 12 is a characteristic diagram when a motor speed is constant in an embodiment of the present invention.

As described above, in this embodiment, the process torque is outputted as the process limitation torque Ta1 limited to at or below a predetermined value in the process system limit unit 33. In this embodiment, FIG. 12 shows the characteristic diagram when the process torque is limited and then outputted as the process limitation torque Ta1 while the motor speed is constant at 300 min−1. After 0.8 second from the top dead center, the motor torque (only the process torque) rises steeply, but its peak value is limited to approximately 20 kNm. The dashed line shows the motor torque without torque limitation as a reference. This process limitation torque Ta1 and control torque Tb are combined in the combination unit 30, and inputted into the drive system limit unit 33. Then, the torque limited to at or below the torque capability of the press drive system is outputted to the amplifier 25.

Figure 13:
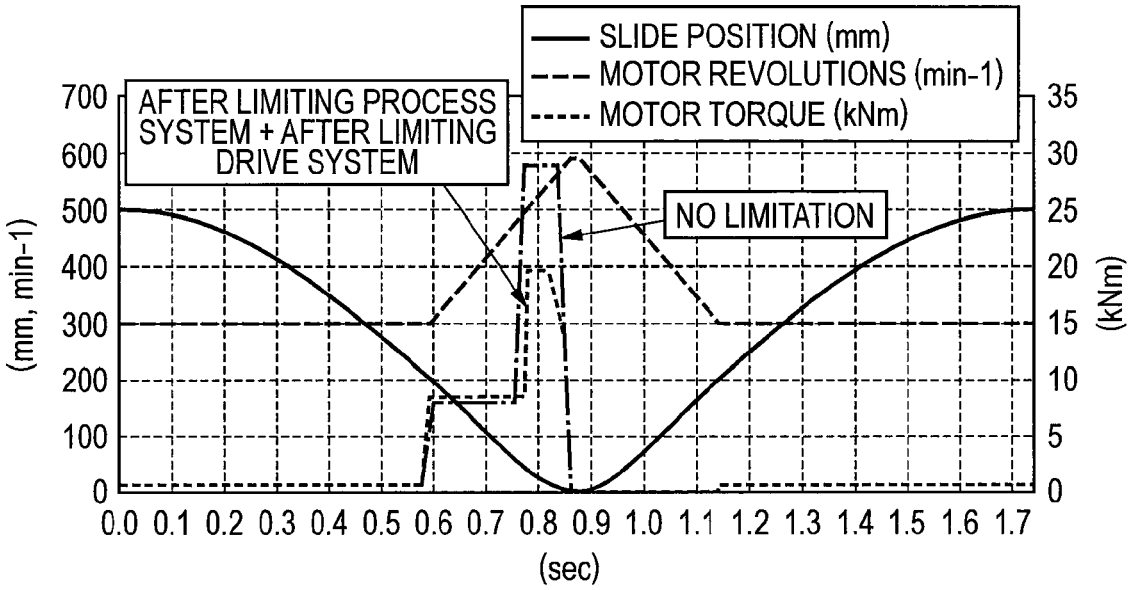
FIG. 13 is a characteristic diagram when a motor speed is changed in an embodiment of the present invention.

In this embodiment, FIG. 13 is the characteristic diagram of the motor torque limited to at or below the torque capability of the press drive system in the drive system limit unit 33 while the motor speed is raised from 300 min−1 to 600 min−1 toward the bottom dead center after 0.6 second near a position of 200 mm from the press bottom dead center. The torque of about 8 kNm is generated for accelerating the motor after 0.6 second, the torque of about 12 kNm required for the pressing is added to this torque, and as a result, the motor torque is limited to approximately 20 kNm. The dashed line shows the motor torque without torque limitation as a reference.

In this embodiment, as shown in FIG. 12 and FIG. 13, the limitation of the process system torque and the limitation of the combined torque of the processing system torque and the drive system torque are carried out certainly separately.

As mentioned above, according to this embodiment, to calculate motor torque required for pressing, process torque required for the pressing and control torque required for speed change of the motor are each calculated on the basis of slide target position data. The process torque is limited to at or below the pressure capability of the press. The torque produced by combining the limited process torque and the control torque is limited to at or below the torque capability of the press drive system. Accordingly, even when the pressing is carried out while the motion is successively changed, which is a property of the servo press, the pressure capability and torque capability of the press can be protected from being exceeded. An overload protection system used in a past machine press stops the press after detecting an overload such as the excess of a press load value. As a result, each time the overload occurs, the press is damaged. In the present invention, the motor torque is limited to avoid the overload on both the pressure capability and torque capability of a press. Accordingly, the press is not damaged.

What is claimed is:

1. A control device of a servo press for pressing by transferring a drive force of a servo motor to a slide via a drive mechanism, the control device comprising:

an encoder for outputting current position data;

a press information storage unit for storing information unique to a press device;

a motion data setting unit for setting therein a slide position and a slide speed;

a motion calculation unit for calculating slide target position data on a basis of information in the encoder, the press information storage unit, and the motion data setting unit;

a torque calculation unit for calculating process torque for pressing and control torque for speed variation of the servo motor on a basis of the slide target position data;

a process system limit unit for limiting the calculated process torque to predetermined torque; and a drive system limit unit for limiting combined torque of the limited process torque and the control torque to predetermined drive torque, the servo motor being driven on a basis of the limited drive torque, wherein the torque calculation unit includes:

a process torque generation unit for calculating and outputting process torque on a basis of the slide target position data and the current position data output from the encoder; and a control torque generation unit for calculating and outputting the control torque by combining acceleration-deceleration torque and inertial torque on a basis of the slide target position data and the information unique to the press device.

2. The control device according to claim 1, wherein the process system limit unit limits the process torque to a value equal to or lower than a unique pressure capability of a press to the press device.

3. The control device according to claim 1, wherein the drive system limit unit limits the combined torque to a value equal to or lower than a torque capability of a drive system unique to the press device.

4. The control device according to claim 1, wherein the acceleration-deceleration torque is determined by motion of the slide and the inertial torque is determined by motor speed and moment of inertia of a drive system.

5. The control device according to claim 1, wherein the information unique to the press device in the press information storage unit is arbitrarily set.

6. A method for controlling a servo press by transferring a drive force of a servo motor driven on a basis of slide target position data to a slide via a drive mechanism, the servo press including:

an encoder for outputting current position data;

a press information storage unit for storing information unique to a press device;

a motion data setting unit for setting therein a slide position and a slide speed; and a motion calculation unit for calculating slide target position data on a basis of information from the encoder, the press information storage unit, and the motion data setting unit, the method comprising steps of:

calculating process torque for pressing and control torque for speed change of the servo motor on a basis of the slide target position data;

limiting the calculated process torque to predetermined process limitation torque;

limiting combined torque of the process limitation torque and the control torque to predetermined drive torque; and driving the servomotor on a basis of limited drive torque, wherein the step of calculating the process torque include calculating the process torque based on the slide target position data and the current position data output from the encoder, and the step of calculating the control torque includes calculating the control torque by combining acceleration-deceleration torque and inertial torque based on the slide target data and the information unique to the press device.

7. The method according to claim 6, wherein the predetermined process limitation torque is equal to or lower than a press pressure capability unique to the press device.

8. The method according to claim 6, wherein the predetermined drive torque is equal to or lower than a drive torque capability of a drive system unique to the press device.

9. The method according to claim 6, wherein the acceleration-deceleration torque is determined by motion of the slide and the inertial torque is determined by motor speed and moment of inertia of the drive system.

* * * * *